US007159951B2

(12) United States Patent
Zhang

(10) Patent No.: US 7,159,951 B2
(45) Date of Patent: Jan. 9, 2007

(54) METHOD OF MANUFACTURING A BRUSH

(75) Inventor: Jun Zhang, Sijhih (TW)

(73) Assignee: Chuen Chern Co., Ltd., Jhonghe (TW)

( * ) Notice: Subject to any disclaimer, the term of this patent is extended or adjusted under 35 U.S.C. 154(b) by 10 days.

(21) Appl. No.: 11/132,560

(22) Filed: May 19, 2005

(65) Prior Publication Data

US 2006/0261664 A1 Nov. 23, 2006

(51) Int. Cl.
*A46D 3/00* (2006.01)

(52) U.S. Cl. ..... 300/21

(58) Field of Classification Search ..... 300/21
See application file for complete search history.

(56) References Cited

U.S. PATENT DOCUMENTS 3,106,739 A * 10/1963 Less ..... 15/198

FOREIGN PATENT DOCUMENTS

GB 2 052 963 * 2/1981

* cited by examiner

*Primary Examiner*—Randall Chin
(74) *Attorney, Agent, or Firm*—Alan D. Kamrath; Nikolai & Mersereau, P.A.

(57) ABSTRACT

A method for manufacturing a brush includes fully and longitudinally filing a bundle of hair into a metal cylinder. One end of the metal cylinder is heated to melt the bundle of hair for forming a combined portion after the melted hair is solidified. The bundle of hair with the combined portion is drawn out from the metal cylinder. At least one through hole is longitudinally defined in the combined portion for outputting material.

6 Claims, 4 Drawing Sheets

METHOD OF MANUFACTURING A BRUSH

BACKGROUND OF THE INVENTION

1. Field of the Invention

The present invention relates to a method and, more particularly, to a method for manufacturing a brush.

2. Description of Related Art

A conventional method for manufacturing a brush longitudinally dips one end of a bundle of hair into glue for combining the bundle of hair. The combined hair is divided into multiple small bundles of hair by a knife and molded by a jig. A through hole is defined in each of the small bundles of hair to receive a steel needle for outputting material.

However, since the conventional brush is dipped into glue, divided by a knife and molded by a jig, the configuration of the conventional brush is difficult to be controlled, and the bundle of hair is easily dispersed. In addition, a steel needle is necessary to output material such that the conventional brush has difficulty to be manufactured and has a high manufacturing cost.

The present invention has arisen to mitigate and/or obviate the disadvantages of the conventional method for manufacturing a brush.

SUMMARY OF THE INVENTION

The main objective of the present invention is to provide an improved method for manufacturing a brush that is conveniently suitable for mounting to the container including material to be applied by the brush and has reduced manufacturing cost.

To achieve the objective, a method in accordance with the present invention fully and longitudinally fills a bundle of hair into a metal cylinder. One end of the metal cylinder is heated to melt the bundle of hair for forming a combined portion after the melted hair is solidified. The bundle of hair with the combined portion is drawn out from the metal cylinder. At least one through hole is longitudinally defined in the combined portion for outputting material for application by the brush.

Further benefits and advantages of the present invention will become apparent after a careful reading of the detailed description with appropriate reference to the accompanying drawings.

DETAILED DESCRIPTION OF THE INVENTION

Figure 1:
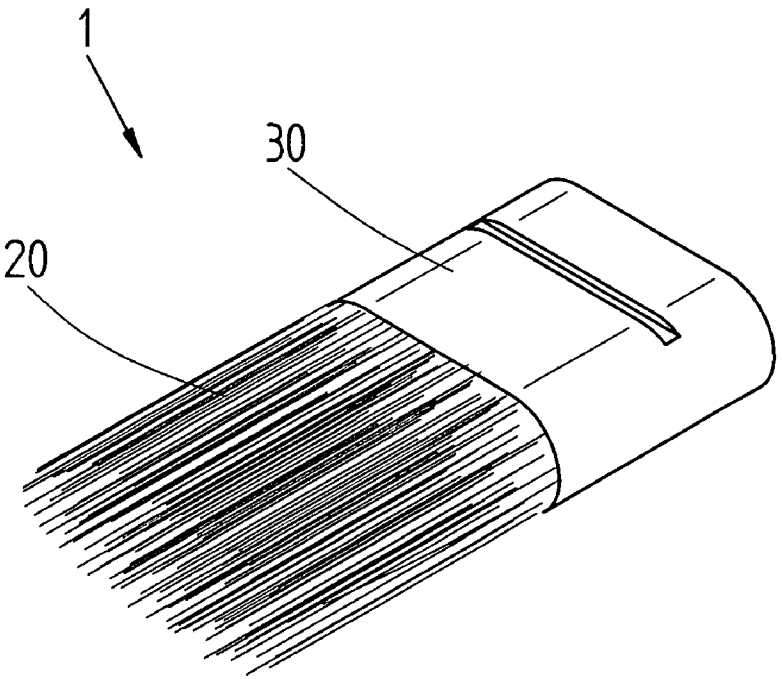
FIG. 1 is a perspective view of a brush that is manufactured by a manufacturing method in accordance with the present invention.
Figure 2:
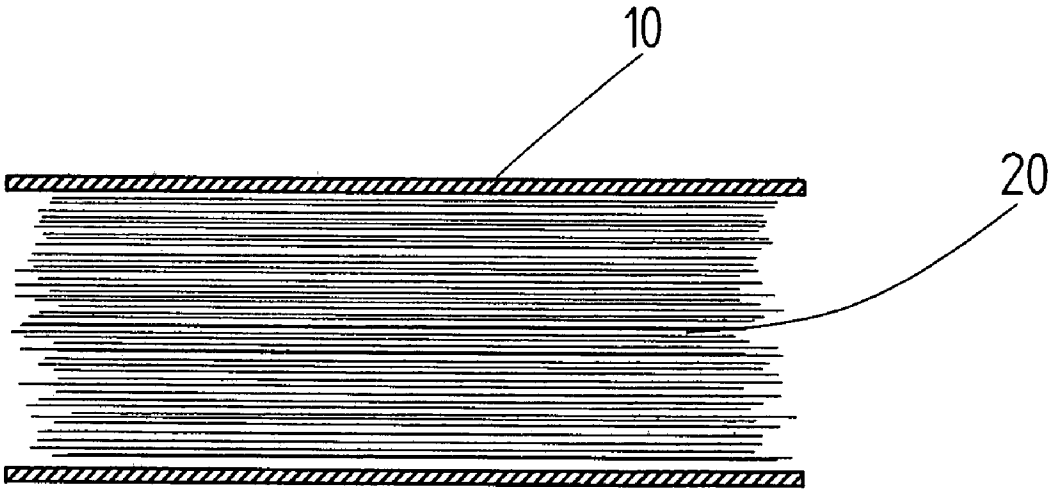
FIG. 2 is a side plan view of the method of the present invention for combined hair.
Figure 3:
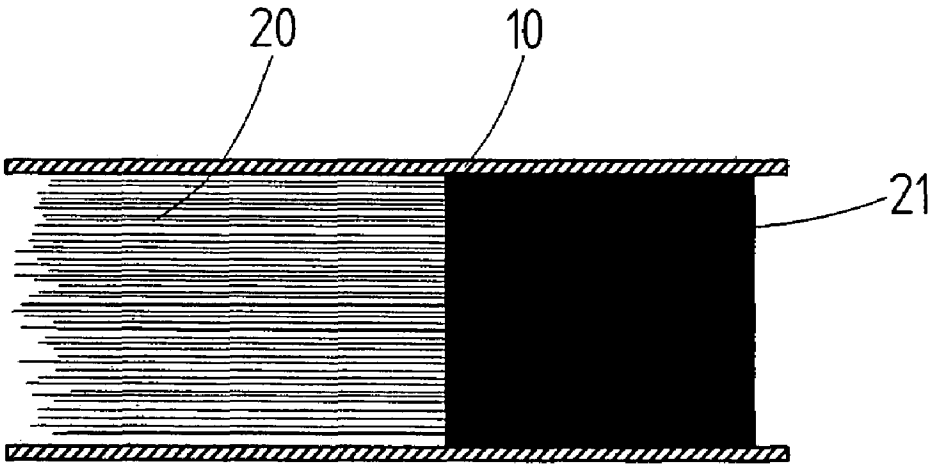
FIG. 3 is a side plan view of the combined hair.
Figure 4:
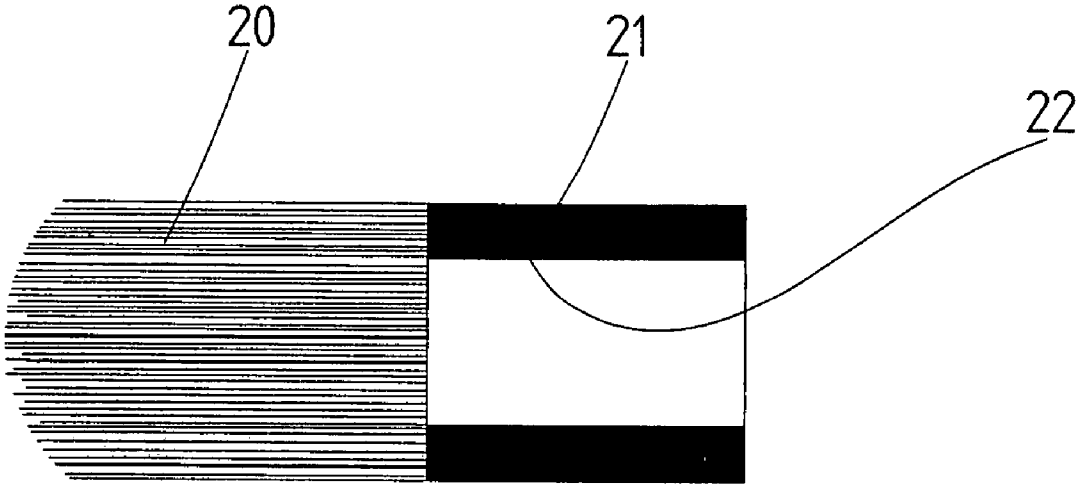
FIG. 4 is a side plan view of a finished brush, wherein at least one through hole is defined therein for outputting material.

Referring to the drawings and initially to FIGS. 1–4, a method for manufacturing a brush 1 in accordance with the present invention includes fully and longitudinally filling a bundle of hair (20) into a metal cylinder (10) as shown in FIG. 2. One end of the cylinder (10) is heated to melt the bundle of hair (20) for forming a combined portion (21) after the melted hair (20) is solidified as shown in FIG. 3. The bundle of hair (20) with the combined portion (21) is drawn out from the metal cylinder (10). At least one through hole (22) is longitudinally defined in the combined portion (21) as shown in FIG. 4 and is for outputting material for application by the brush 1. The metal cylinder (10), as described above, is an aluminum cylinder or a copper cylinder.

With reference to FIG. 1, a sleeve (30) is sleeved on the combined portion (21) such that the brush 1 manufactured by the method of the present invention can by easily adapted to be mounted on a container that contains the material to be applied by the brush 1.

With reference to FIGS. 2–4, the bundle of hair (20) is fully an longitudinally filled into the metal cylinder (10) that is previously configured. One end of the metal cylinder (10) is heated to 230° C. for melting the bundle of hair (20). The melted portion of the bundle of hair (20) is solidified to form a combined portion (21). The bundle of hair (20) is drawn out from the metal cylinder (10) via the combined portion (21) and is cut to the desired length. At least one through hole (22) is longitudinally defined in the combined portion (21) by a drill to allow the material to pass through the at least one through hole (22) for application to a surface by the brush 1.

The bundle of hair (20) is fully filled into the metal cylinder (10) such that the configuration of the brush 1 can be varied due to the previously configured metal cylinder (10). Thus, the brush manufactured by the method in accordance with the present invention is conveniently suitable for mounting to the container. In addition, the combined portion (21) is formed by hot-melt such that the combined portion (21) will not be transformed under a high pressure even through at least one through hole (22) is longitudinally defined therein.

Although the invention has been explained in relation to its preferred embodiment, it is to be understood that many other possible modifications and variations can be made without departing from the spirit and scope of the invention as hereinafter claimed.

What is claimed is:

1. A method for manufacturing a brush, comprising:

fully and longitudinally filling a bundle of hair into a metal cylinder, wherein the metal cylinder has a configuration;

heating one end of the filled metal cylinder to partially melt a portion of the bundle of hair in the metal cylinder, with the melted portion of the bundle of hair forming a combined portion after solidifying;

drawing the bundle of hair out from the metal cylinder with the combined portion; and longitudinally defining at least one through hole in the combined portion to allow material to pass through the at least one through hole for application to a surface by the brush.

2. The method as claimed in claim 1 further comprising sleeving a sleeve on the combined portion such that the brush is easily adapted to be mounted on a container that contains material for passing through the at least one through hole.

3. The method as claimed in claim 2, wherein the metal cylinder is made of aluminum.

4. The method as claimed in claim 2, wherein the metal cylinder is made of copper.

5. The method as claimed in claim 1, wherein the metal cylinder is made of aluminum.

6. The method as claimed in claim 1, wherein the metal cylinder is made of copper.

* * * * *